US006874301B2

(12) United States Patent
Kitamoto

(10) Patent No.: US 6,874,301 B2
(45) Date of Patent: Apr. 5, 2005

(54) CAPPING METHOD AND APPARATUS

(75) Inventor: Hiroaki Kitamoto, Ishikawa-Ken (JP)

(73) Assignee: Shibuya Kogyo Co., Ltd., Ishikawa-Ken (JP)

( * ) Notice: Subject to any disclaimer, the term of this patent is extended or adjusted under 35 U.S.C. 154(b) by 0 days.

(21) Appl. No.: 09/777,378

(22) Filed: Feb. 6, 2001

(65) Prior Publication Data

US 2001/0018820 A1 Sep. 6, 2001

(30) Foreign Application Priority Data

Mar. 6, 2000 (JP) ..... 2000-060594

(51) Int. Cl.[7] ..... B67B 3/20

(52) U.S. Cl. ..... 53/490; 53/476; 53/484; 53/485; 53/317; 53/331.5

(58) Field of Search ..... 53/490, 476, 484, 53/485, 317, 331.5

(56) References Cited

U.S. PATENT DOCUMENTS 4,249,362 A * 2/1981 Brownbill ..... 53/331.5
4,254,603 A * 3/1981 Obrist ..... 53/331.5
4,494,358 A * 1/1985 Zalkin ..... 53/331.5
4,614,077 A * 9/1986 Muto et al. ..... 53/317
4,811,857 A * 3/1989 Thompson ..... 215/329
5,321,935 A * 6/1994 Spatz et al. ..... 53/317
5,400,564 A * 3/1995 Humphries et al. ..... 53/75
5,687,552 A * 11/1997 Barca ..... 53/490
5,718,097 A * 2/1998 Kinoshita et al. ..... 53/75
6,105,343 A * 8/2000 Grove et al. ..... 53/490
6,371,319 B2 * 4/2002 Yeaton et al. ..... 215/352

FOREIGN PATENT DOCUMENTS

JP 7-86034 9/1995
JP 11-124196 5/1999

* cited by examiner

*Primary Examiner*—Scott A. Smith
*Assistant Examiner*—Brian D. Nash
(74) *Attorney, Agent, or Firm*—Flynn, Thiel, Boutell & Tanis, P.C.

(57) ABSTRACT

A capping apparatus 1 includes torque sensor 12 which detects an output torque when a chuck 7 is driven for rotation by a motor 9. Initially, a cap 5 is held by the chuck 7. The cap 5 is fitted over a mouth of a vessel 2, and then the chuck 7 is rotated through one revolution in a clamping direction. A resulting output torque is detected by the torque sensor 12, and the output torque rapidly increases at the position where the threads on the cap 5 and the vessel 2 abut against each other (an incipient position of meshing engagement P). The cap 5 is rotated through a given angle of rotation as referenced to the incipient position of meshing engagement P, thus threadably engaging the cap 5 with the vessel 2. The invention allows a uniform clamping of cap 5 at the completion of the capping operation.

11 Claims, 8 Drawing Sheets

CAPPING METHOD AND APPARATUS

FIELD OF THE INVENTION

The present invention relates to a capping method and apparatus, and more particularly, a capping method and apparatus in which an incipient position of a meshing engagement between threads on a vessel and threads on a cap is detected and then the cap is turned through a given angle of rotation as referenced to the detected position to clamp the cap onto the vessel.

DESCRIPTION OF THE PRIOR ART

A capping method of the kind described is known in the art (see for example, Japanese Patent Publication No. 86,034/1995 and Japanese Laid-Open Patent Application No. 124,196/1999).

In the disclosed method, the incipient position of a meshing engagement between the threads on the vessel and the threads on the cap is detected by initially fitting the cap over the threads on the vessel from above and turning the cap in a direction opposite from the direction in which it is clamped. The distal end of the threads on the cap which is located at the bottom thereof is disengaged from the top end of the threads on the vessel, whereby the cap falls down by a vertical distance corresponding to one pitch of the threads on the vessel vertically. In the conventional method, the point which the cap reaches upon descent through such a significant distance is detected as the incipient position of a meshing engagement between the threads on the vessel and the threads on the cap.

According to the conventional method, the incipient position of a meshing engagement between both threads is determined on the basis of the magnitude of descent of the cap, and this, disadvantageously, requires the provision of means for detecting the descent. Such detecting means would include a vertically slidable component, which undergoes an abrasion, thus presenting a problem in respect of durability.

In addition, with the conventional method, in order to assure the descent of the cap, a turning of the cap in the opposite direction takes place under a clamping condition, i.e., while the threads on the cap are strongly urged against the threads on the vessel. A likelihood then arises that the threads on the cap and/or the vessel may be damaged.

SUMMARY OF THE INVENTION

In view of the foregoing, in accordance with the present invention, there is provided a capping method which uses a capping head for holding a cap and a motor for rotating the capping head to turn a cap held by the capping head in a clamping direction so that the cap can be clamped to a vessel with a predetermined winding angle, comprising the steps of measuring a change in a force acting on the cap as distal ends of threads on the cap and the vessel contact each other during the relative rotation of both threads;

and detecting an incipient position of a meshing engagement where the distal ends of both threads contact on the basis of the change in the acting force.

According to another aspect of the invention, there is provided a capping apparatus including a capping head for holding a cap and a motor for rotating the capping head, the cap held by the capping head being turned in a clamping direction so that the cap can be clamped to a vessel with a predetermined winding angle, the apparatus further comprising:

an elevating mechanism for elevating the capping head up and down;

measuring means for measuring a change in a force acting on the cap which is held by the capping head;

angle detecting means for detecting an angular position to which the capping head is rotated;

and control means for controlling the rotation of the motor in response to a result of a measurement from the measuring means and an angle signal from the angle detecting means;

the control means being arranged such that in the course of a descent of the capping head to an elevation where a clamping of the cap is to be initiated, it causes the capping head to rotate either forwardly or reversely with respect to the clamping direction to cause distal ends of both threads on the cap and the vessel to contact each other, the control means detecting an incipient position of a meshing engagement between both threads where their distal ends contact each other on the basis of a change in the force acting on the cap.

With the described arrangement, the incipient position of a meshing engagement can be detected accurately, allowing the cap to be turned through a given angle of rotation as referenced to the incipient position, achieving a uniform clamping of caps to the vessels.

Above and other objects, features and advantages of the invention will become apparent from the following description of several embodiments thereof with reference to the attached drawings.

DETAILED DESCRIPTION OF THE EMBODIMENT

First Embodiment

Figure 1:
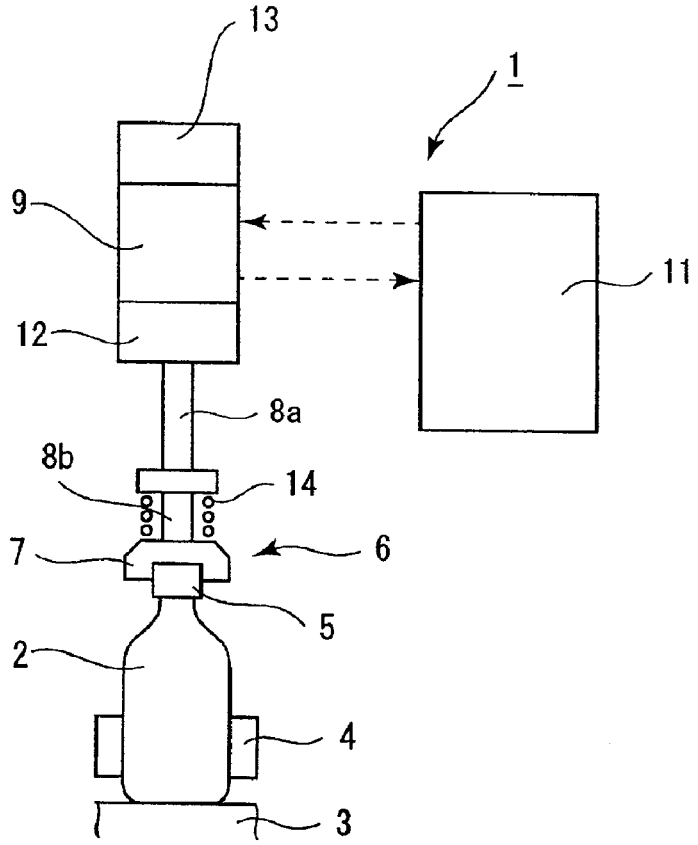
FIG. 1 is a front view of essential parts of a first embodiment of the invention.

Referring to the drawings, several embodiments of the invention will now be described. A capping apparatus 1 includes a revolving body, not shown, which is rotatable in a horizontal plane. A plurality of receptacles 3 are disposed at an equal angular interval along the outer periphery of the revolving body, each receiving a vessel 2 thereon. A gripper 4 is associated with each receptacle 3 and is disposed on the revolving body to grip the barrel of the vessel 2. A capping head 6 is located above each receptacle 3 for holding a cap 5 for threadable engagement with the mouth of the vessel 2.

Figure 2:
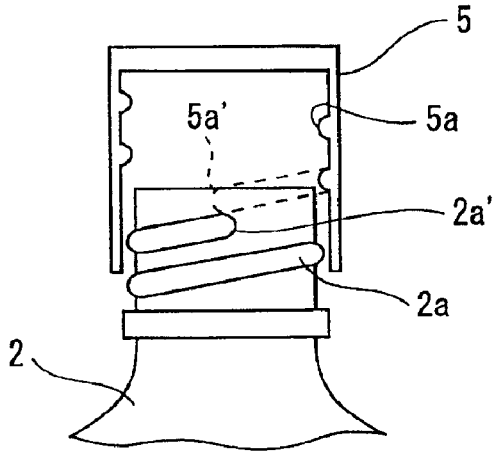
FIG. 2 is an illustration of a cap 5 before it is threadably engaged with a vessel 2 in the first embodiment.

As shown in FIG. 2, on its outer peripheral surface, the mouth of the vessel 2 is formed with male threads 2*a* while the inner peripheral surface of the cap 5 is formed with female threads 5*a*.

The capping head 6 includes a chuck 7, which is known in itself, for detachably holding the cap 5 under pneumatic pressure, and a pair of upper and lower splined shafts 8*a*, 8*b* which are coupled to the chuck 7. The splined shafts 8*a*, 8*b* are mechanically coupled to a motor 9, the operation of which is in turn controlled by a controller 11. Thus, when the motor 9 is set in motion to rotate the splined shafts 8*a*, 8*b* and the chuck 7 in a direction to clamp the cap, the cap 5, which is held by the chuck 7, is threadably engaged around the mouth of the vessel 2.

Torque measuring means 12, which measures a force acting upon the cap 5 held by the capping head 6 as a rotational load, and an encoder 13, acting as angle detecting means, are connected to the motor 9. In this manner, when the motor 9 is set in motion, an output torque from the motor 9 is detected by the torque measuring means 12, with a result of measurement being fed to the controller 11. At the same time, an angular position of rotation of the motor 9 is detected by the encoder 13, which feeds an angle signal to the controller 11.

The splined shafts 8*a*, 8*b* are constructed to be slidable through a given stroke relative to each other in the axial or vertical direction, and buffer spring 14 is disposed between the chuck 7 and the upper splined shaft 8*a*. As a consequence, before the cap 5 is mounted on the vessel 2, the chuck 7 is urged to its lowermost position with respect to the upper splined shaft 8*a*.

Each capping head 6 and its associated motor 9 are arranged to be elevatable up and down by an elevating mechanism which comprises an annular elevating cam, not shown, which is disposed along the outer circumference of the revolving body.

To achieve a threadable engagement of the cap 5 around the mouth of the vessel 2, the elevating cam causes the capping head 6 and the motor 9 to move from their raised end positions to their descended end positions, whereby the cap 5 held by the chuck 7 is fitted over the upper end of the vessel 2 and is urged downward. This causes the spring 14 to be compressed, whereby the chuck 7 and its connected lower splined shaft 8*b* are raised upward relative to the upper splined shaft 8*a* while urging the cap 5 held by the chuck 7 against the vessel 2.

When the controller 11 sets the motor 9 in motion to rotate the chuck 7 in the clamping direction while the cap 5 is urged in this manner, the female threads 5*a* on the cap 5 are ready for threadable engagement with the male threads 2*a* on the vessel 2. Subsequently as the cap 5 is released from the holding action of the chuck 7, the capping head 6 is raised to its original raised position under the influence of the elevating cam.

In this embodiment, on the basis of a change in the value of output torque detected by the torque measuring means 12 as the motor 9 is set in motion, a position P where the upper end 2*a*- of the male threads 2*a* on the vessel 2 (upper distal end of the male threads) is contacted by the lower end 5*a*- of the female threads on the cap 5 (lower distal end of the female threads) is detected which is defined as the incipient position of a meshing engagement therebetween. The cap 5 is then turned through a given angle of rotation as referenced to the incipient position in the clamping direction by means of the motor 9 for achieving a capping operation.

Figure 3:
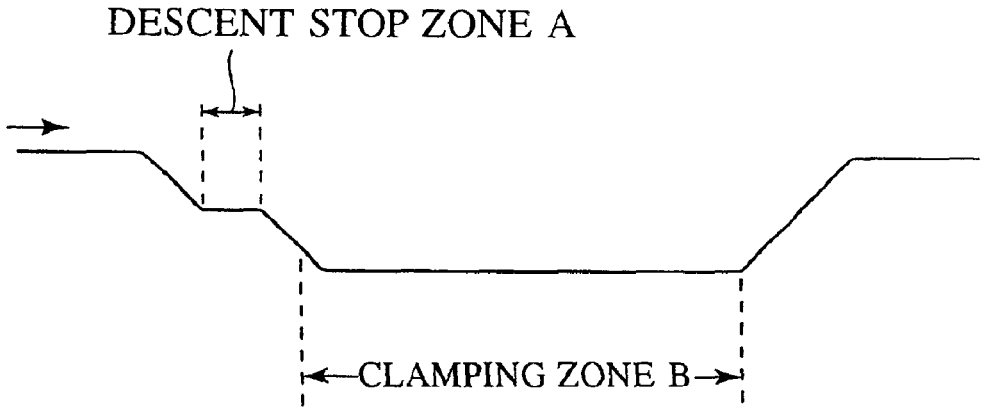
FIG. 3 graphically shows a relationship between an elevational motion and a travel of a capping head in the first embodiment.

Specifically, referring to FIG. 3, the cam surface of the elevating cam is formed with a descent stop zone A toward the left end, as viewed in FIG. 3, where the capping head 6 ceases to descend and maintains the same elevation while it travels. The descent stop interval A is provided in the course of a descent of the capping head 6 to the elevation of the clamping zone B at a location where the cap 5 is fitted over the vessel 2, but before the female threads 5*a* on the cap 5 are urged against the male threads 2*a* on the vessel 2 by the spring 14.

The action of the capping head 6 to urge the cap 5 begins before the elevating cam reaches its lowermost point, and accordingly, the beginning point of a clamping zone B is located short of the lowermost point in FIG. 3.

When the capping head 6 is positioned in the descent stop zone A, the cap 5 held by the capping head 6 has an elevation which is chosen to be such that the lowest extremity of the lower end 5*a*- of the female threads 5*a* on the cap 5 can abut vertically against the top extremity of the upper end 2*a*- of the male threads 2*a* on the vessel 2, as shown in FIG. 2. If the cap 5 is turned at this elevation, it is assured that the lower end 5*a*- of the female threads 5*a* abuts against the upper end 2*a*- of the male threads 2*a* on the vessel 2 during such rotation, producing a rotational load which is applied to the cap 5.

In the present embodiment, while the capping head 6 ceases its descent in the descent stop zone A, the torque measuring means 12 detects an output torque from the motor 9 while the controller 11 causes the motor 9 to rotate through one revolution in either a forward or reverse direction, thus causing the cap 5 held by the chuck 7 on the capping head 6 to rotate through one revolution either forwardly or reversely.

Figure 4:
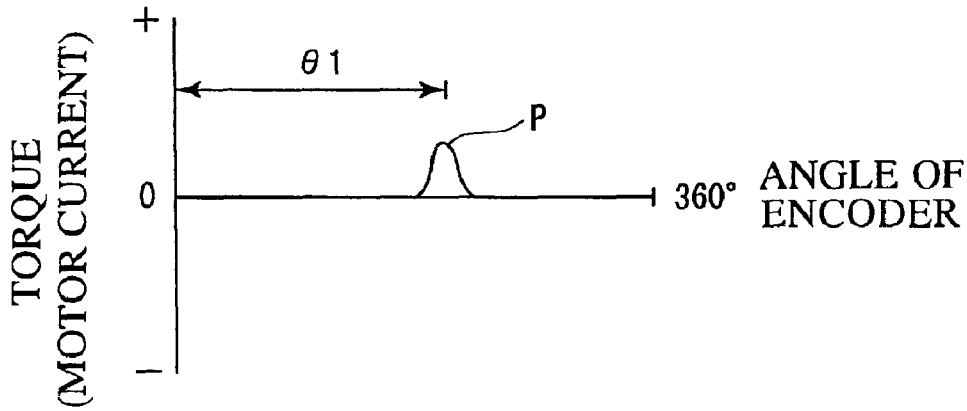
FIG. 4 is a diagram showing a relationship between a value of an output torque detected with a torque sensor and an angle of rotation of an encoder in the first embodiment.
Figure 5:
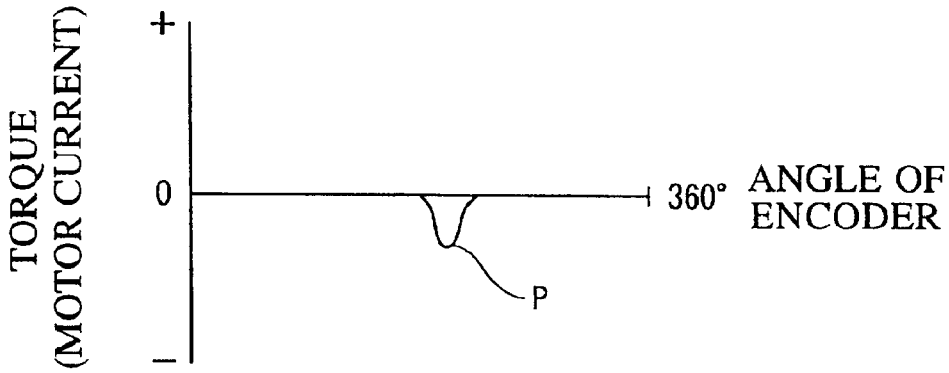
FIG. 5 is a similar view to FIG. 4.

When the cap 5 is rotated through one revolution, it follows that the lower end 5*a*- of the female threads 5*a* on the cap 5 once abuts against the upper end 2*a*- of the male threads 2*a* on the vessel 2 during such rotation, and at the instant of abutment, an output torque or a rotational load which has a maximum magnitude during the one revolution rotation of the cap 5 is measured. When a result of this measurement is input to the controller 11, the latter recognizes a prevailing angular position by means of the encoder 13. FIG. 4 shows a relationship between the output torque detected by the torque measuring means 12 with respect to the angular position of rotation of the motor 9 or the angular position of rotation of the cap 5 and the capping head 6 detected by the encoder 13 during the time the motor 5 causes the cap 5 to rotate through one revolution in the clamping direction. When the lower end 5*a*- of the female threads 5*a* on the cap 5 abuts against the upper end 2*a*- of the female threads 2*a* on the vessel 2, there occurs a rapid increase in the output torque as indicated by a peak in FIG. 4. This position represents the incipient position P of meshing engagement. It is to be noted that the torque measuring means 12 is designed to measure the magnitude of the current which is supplied to the motor 9. Thus, the magnitude of the current supplied to the motor 9 increases when there is a rotational load. This is indirectly determined as a change in the output torque, and the incipient position of meshing engagement P is detected as an angular position of rotation where the magnitude is equal to or greater than a given value.

Where the cap 5 is rotated through one revolution in the reverse direction or in a direction opposite from the clamping direction by means of the motor 9, the current supplied will be represented as a negative value, and a resulting change in the output torque will be indicated by a negative peak as shown in FIG. 5.

While the magnitude of the current supplied to the motor 9 is detected as an indication of the output torque by the torque measuring means in the above description, it should be understood that the magnitude of the voltage across the motor 9 may be used instead, or alternatively, an actual output torque may be directly detected.

Although the incipient position of meshing engagement P can be detected in the manner mentioned above, it is to be noted that in the present embodiment, because the cap 5 is rotated through one revolution, the cap 5 comes to a stop beyond the incipient position of meshing engagement P. In addition, the position where it comes to a stop varies from time to time. Accordingly, the controller 11 calculates, as an offset θ1 an angle of rotation from the start position where the motor 9 or the chuck 7 begins to rotate or the position where the chuck 7 or the cap 5 which remains stationary presently assumes to the incipient position of meshing engagement P as viewed in the clamping direction (FIG. 4) when the cap 5 is rotated in the forward direction.

When the cap 5 is rotated in the reverse direction, the offset θ1 is calculated as an angle of rotation from the incipient position of meshing engagement P to the stop position, as viewed in the direction opposite from the clamping direction.

In the present embodiment, the controller 11 is preset to cause the cap 5 to rotate through a given angle θ2 from the incipient position of meshing engagement P, and accordingly, the controller 11 adds the offset θ1 to the given angle of rotation θ2 to determine the angle of rotation θ3 through which the motor 9 is to be rotated in the clamping direction.

When the capping head 6 has moved past the descent stop zone A and again descended to cause the female threads 5 on the cap 5 to be urged against the male threads 2*a* on the vessel 2, and the capping head 6 is thus positioned in the clamping zone B, the controller 11 causes the motor 9 to rotate again through the angle of rotation θ3 in the clamping direction, thus rotating the chuck 7 through the angle of rotation θ3 in the clamping direction. Thereupon, the cap 5 which is held by the chuck 7 is rotated through the angle of rotation θ3 from the stop condition which it presumed previously, whereby the cap 5 is rotated through the given angle of rotation θ2 from the incipient position of meshing engagement P in the clamping direction, thus allowing the female threads 5*a* on the cap 5 to be clamped around the male threads 2*a* on the vessel 2 with a predetermined winding angle. The capping apparatus 1 of the present embodiment is constructed to allow the cap 5 to be threadably engaged around the mouth of the vessel 2 in this manner.

It is to be understood that the incipient position of meshing engagement P merely represents a reference position, and if the configuration of the threads on the vessel and/or cap is modified, such position moves back and forth. To achieve a required winding angle, an optimum winding angle, which is referenced to the incipient position of meshing engagement which is determined for a particular combination of a vessel and a cap which are to be capped together, is previously determined, and is chosen as a given angle θ2.

Thus it will be seen that in the present embodiment, the incipient position of meshing engagement P is detected in terms of a change in an output torque from the torque measuring means 12, and the cap 5 is rotated through the given angle of rotation θ2 as referenced to the incipient position of meshing engagement P thus determined, thus causing it to be threadably engaged with the vessel 2. This allows the incipient position of meshing engagement P to be detected accurately, and a subsequent clamping operation takes place always uniformly as the cap 5 is capped to assure a capping operation of a high precision.

As an alternative to the described technique, the detection of the incipient position of meshing engagement P may comprise a sampling of an output torque by means of the controller 11 each time the motor 9 rotates through one revolution, and comparing a current sample against a previous sample. If there is a rapid increase in the output torque, this may be used as an indication of the incipient position of meshing engagement P.

In the first embodiment mentioned above, the motor 9 is caused to rotate through one revolution and to stop then in the descent stop zone A. However, the rotation of the motor 9 may be stopped upon detection of the incipient position of meshing engagement P where there occurs a rapid increase in the output torque. It should be understood that the addition of the offset θ1 is omitted in this instance.

Second Embodiment

Figure 6:
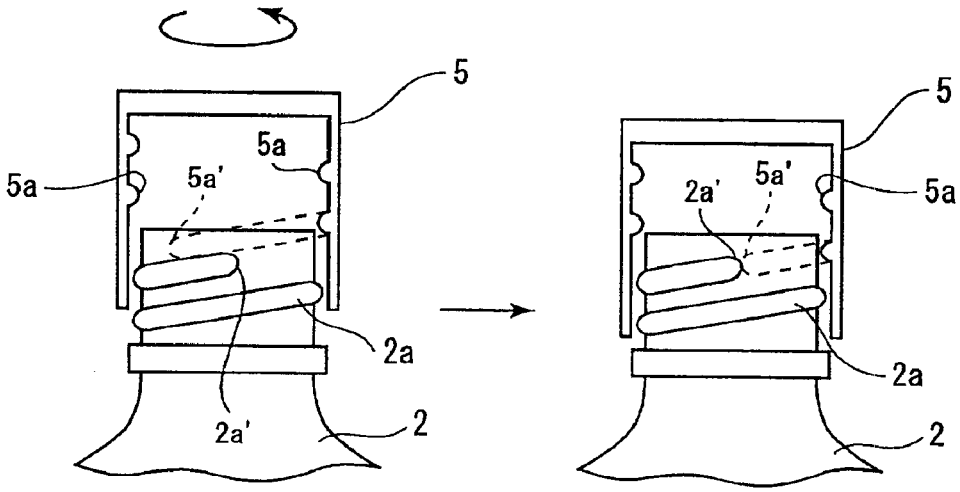
FIG. 6 illustrates a cap 5 before it is threadably engaged with a vessel 2 according to a second embodiment of the invention.
Figure 7:
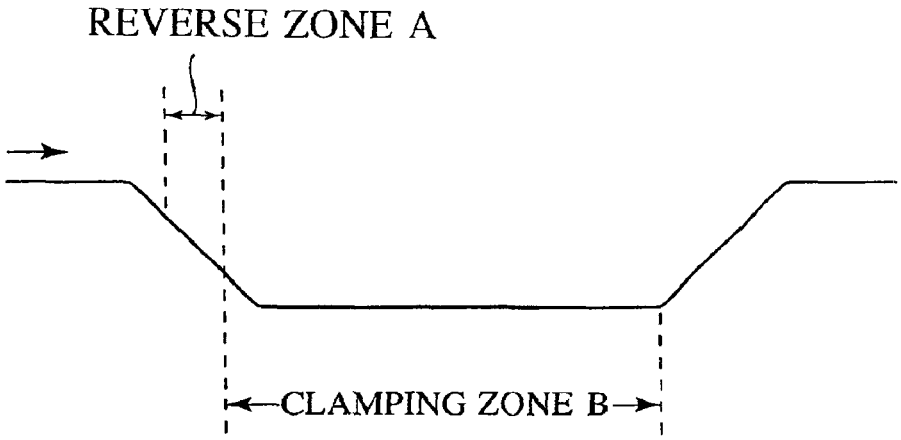
FIG. 7 graphically shows a relationship between an elevational motion and a travel of a capping head in the second embodiment.
Figure 8:
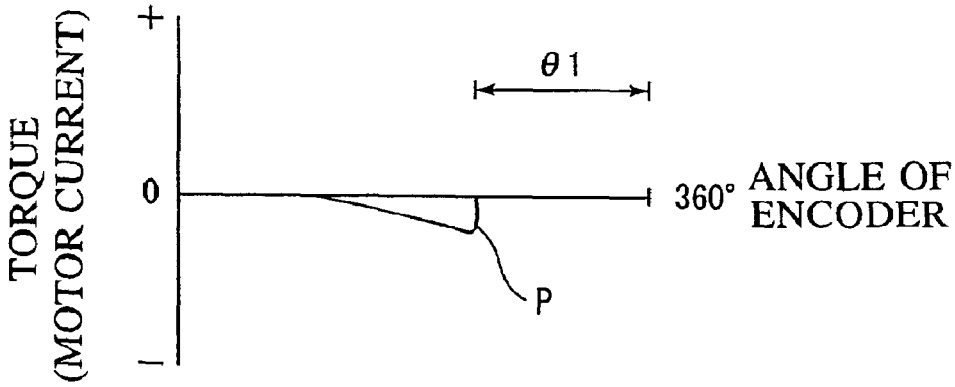
FIG. 8 is a diagram showing a relationship between a value of an output torque detected with a torque sensor and an angle of rotation of an encoder in the second embodiment.

FIGS. 6 to 8 show a second embodiment of the invention. In this embodiment, there is provided a reverse zone A as shown in FIG. 7 where the controller 11 causes the motor 9 to be rotated through one revolution in a direction opposite from the clamping direction in a region where the elevating cam causes the capping head 6 to descend. In the reverse zone A, at least the lowest extremity 5*a*- of the female threads 5*a* on a cap 5 is enabled to abut against the top end 2*a*- of the male threads 2*a* on a vessel 2 (see left part of FIG. 6). In other words, the motor 9 is controlled so that in the course of descent of the capping head 6, the cap 5 is caused to rotate through one revolution in the reverse direction at the time when the lowest extremity 5*a*- of the female threads 5*a* on the cap 5 is located below the uppermost portion of the top end 2*a*- of the male threads 2*a* on the vessel 2.

When the cap 5 is rotated through one revolution in the reverse direction, as shown in FIG. 6, the output torque gradually increases (see FIG. 8) as a result of a sliding motion of the lowest extremity 5*a*- of the female threads 5*a* on the cap 5 along a portion of the male threads 2*a* on the cap 2 which is located to the left of the top end 2*a*-, as indicated in the left part of FIG. 6. When the lowest extremity 5*a*- of the female threads 5*a* on the cap 5 is disengaged from the top end 2*a*- of the male threads 2*a* on the vessel 2, as will be noted in the right part of FIG. 6, there occurs a rapid decrease in the output torque to zero (see point P shown in FIG. 8). In this manner, a point where the output torque rapidly decreases after its gradual increase defines the incipient position of meshing engagement P.

The controller 11 then calculates an offset θ1 in the angle of rotation in the reverse direction through which the cap 5 rotates from the incipient position of meshing engagement P to its stop position, from an angle signal from the encoder 13, and adds the offset θ1 to the predetermined given angle of rotation θ2 to derive an angle of rotation θ3 through which the cap 5 is to be rotated from the current stop position.

Subsequently the capping head 6 continues to descend, and the female threads 5*a* on the cap 5 are urged against the male threads 2*a* on the vessel 2. When the clamping zone B is reached, the controller 11 causes the motor 9 to rotate through the angle of rotation θ3 in the clamping direction, whereby the cap 5 held by the chuck 7 is also rotated through the angle of rotation θ3. As a consequence, the cap 5 is rotated through the given angle of rotation θ2 as counted from the incipient position of meshing engagement P in the clamping direction, whereby the female threads 5*a* on the cap 5 are threadably engaged with the male threads 2*a* on the vessel 2.

The second embodiment achieves a similar functioning and effect as achieved by the first embodiment. In addition, with the second embodiment, when the cap 5 is rotated in the reverse direction, it is to be noted that the cap 5 is not yet urged downward by the spring 14, and thus a likelihood is avoided that the lowest extremity 5*a*- of the female threads 5*a* on the cap 5 may be disengaged from the top end 2*a*- of the male threads 2*a* on the cap 2 to damage the female threads 5*a* on the cap 5 and/or the male threads 2 on the cap 2 when the female threads ha on the cap 5 descend through a distance corresponding to the vertical width of the male threads 2*a* on the cap 2.

In the above description, the reverse operation takes place during the descent of the capping head 6. However, a temporary stop of descent in the reverse zone A may be employed.

Alternatively, the reverse rotation of the cap 5 may be stopped at a position P where a change in the output torque is detected.

Third Embodiment

Figure 9:
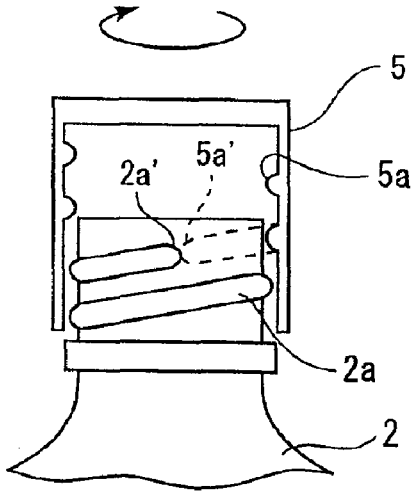
FIG. 9 is an illustration of a cap 5 before it is threadably engaged with a vessel 2 according to a third embodiment of the invention.
Figure 10:
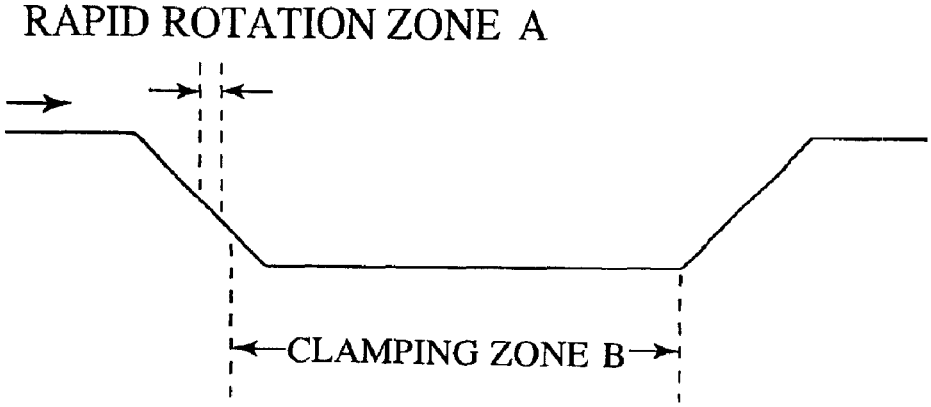
FIG. 10 graphically shows a relationship between an elevational motion and a travel of a capping head in the third embodiment.
Figure 11:
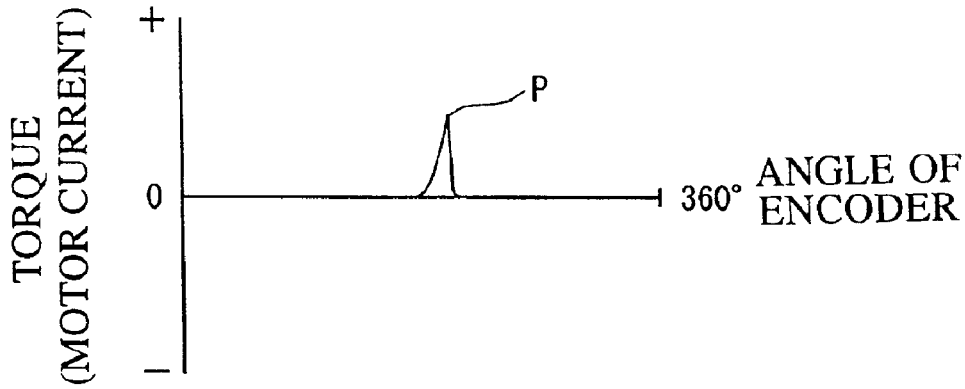
FIG. 11 is a diagram showing a relationship between a value of an output torque detected with a torque sensor and an angle of rotation of an encoder in the third embodiment.

FIGS. 9 to 11 illustrates a third embodiment of the invention. In the third embodiment, there is provided a rapid rotation zone A where the cap 5 is rapidly rotated in the clamping direction, the rapid rotation zone A being provided in the course of descent of the capping head 6 which takes place under the influence of the elevating cam and before the capping head 6 descends to the clamping zone B. In the rapid rotation zone A, the controller 11 drives the motor 9 to cause the cap 5 to rotate in the clamping direction from a point in time when at least the lowest extremity 5*a*- of the female threads 5*a* on the cap 5 does not abut against the top end 2*a*- of the male threads 2*a* on the vessel 2.

At this time, a rotational speed of the motor 9 is chosen to be such that the cap rotates at least through one revolution during the time the cap 5 descends in the vertical direction by an amount corresponding to the width of a single one of the male threads 2*a* on the cap 2 under the influence of the elevating cam. The rotational speed of the motor 9 in the rapid rotation zone A is higher than the rotational speed which is used during the capping operation (the speed with which the capping head 6 is caused to descend under the influence of the elevating cam is greater than the speed with which the cap 5 descends while rotating in order to prevent the vessel 2 from being lifted up at the commencement of the clamping operation).

As a consequence, it is assured that the lower extremity 5*a*- of the female threads 5*a* on the cap 5 abuts against the top end 2*a*- of the male threads 2*a* on the vessel 2 during the rotation through one revolution, as indicated in FIG. 9, whereby an increase in the output torque is detected by the torque measuring means 12 (see P in FIG. 11). The position P represents a position where the meshing engagement is initiated.

In this embodiment, as soon as the abutment of the lowest extremity 5*a*- of the female threads 5*a* on the cap 5 against the top end 2*a*- of the male threads 2*a* on the vessel 2 is detected or as soon as the incipient position of the meshing engagement P is detected, the controller 11 ceases to rotate the cap 5.

The rotation of the cap 5 is ceased for the following reason: in this embodiment, depending on the elevation of the cap 5 when it abuts against the male threads 2*a* on the vessel 2, it is uncertain whether the female threads 5*a* on the cap 5 are located on the upside or downside of the male threads 2*a* on the vessel 2 for threadable engagement. If the female threads 5*a* on the cap 5 are located on the underside of the male threads 2 on the vessel 2 to proceed into the threadable engagement, the capping head 6 is not yet descended enough, whereby the vessel 2 may be lifted up. However, because the capping head 6 continues to descend to be situated in the clamping zone B, the female threads 5*a* on the cap 5 can be urged against the male threads 2*a* on the vessel 2.

In the present embodiment, at the time the incipient position of meshing engagement P is detected, the cap 5 is stopped by interrupting the rotation of the motor 9, and when the capping head 6 reaches the clamping zone B, the controller 11 causes the cap 5 which has been stationary to rotate through a given angle θ2 to complete the clamping operation. However, as the incipient of the meshing engagement P is detected, the cap 5 rotates through a certain angle before it stops, and accordingly, the given angle θ2 is chosen in consideration of this.

If the female threads 5*a* on the cap 5 are located on the upside of the male threads 2*a* on the vessel 2 after the lowest extremity 5*a*- of the female threads 5*a* on the cap 5 abuts against the top end 2*a*- of the male threads 2*a* on the vessel 2, it will be seen that the angle through which the cap is rotated to complete the clamping will be by one revolution less than when the lowest extremity is located below the top end 2*a*-. Accordingly, the controller 11 detects the magnitude of the torque upon completion of the clamping operation. If the magnitude of the torque is less than a given value, the controller 11 determines that one more revolution is wanting and thus modifies the angle of rotation for the cap 5 so that a predetermined angle of rotation required for the clamping operation can be satisfied. It is to be understood that the given angle θ2 is set up for the instance when the lowest extremity 5*a*-is located below the top end 2*a*-.

Fourth Embodiment

Figure 12:
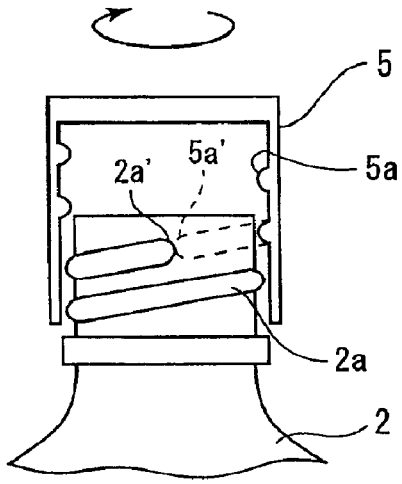
FIG. 12 illustrates a cap 5 before it is threadably engaged with a vessel 2 according to a fourth embodiment of the invention.
Figure 13:
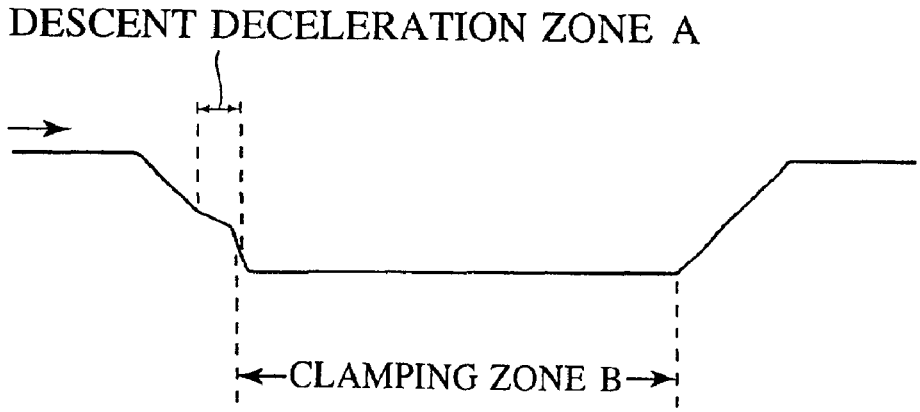
FIG. 13 graphically shows a relationship between an elevational motion and a travel of a capping head in the fourth embodiment.
Figure 14:
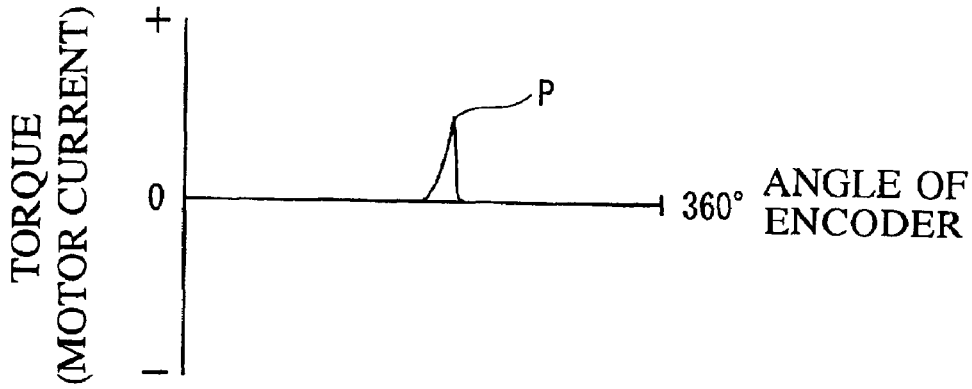
FIG. 14 is a diagram showing a relationship between a value of an output torque detected with a torque sensor and an angle of rotation of an encoder in the fourth embodiment.

FIGS. 12 to 14 show a fourth embodiment of the invention. In contrast to the third embodiment in which the capping head 6 is moved up and down by means of the elevating cam, in the fourth embodiment, the elevating cam used in the third embodiment is replaced by an elevating mechanism which is driven by a servo motor. Accordingly, the amount of elevational movement can be freely changed from capping head 6 to capping head.

A descent deceleration zone A is provided in the course of descent for the capping head 6. A descending speed of the capping head 6 is chosen in the descent deceleration zone A so that the cap 5 rotates through at least one revolution during the time the capping head 6 descends through a distance corresponding to the vertical width of one of the male threads 2*a* on the vessel 2. The motor 9 causes the cap 5 to rotate in the clamping direction in the descent deceleration zone A.

When the cap 5 is rotated in the descent deceleration zone A, it is assured that the lowest extremity on the cap 5 abuts against the top end 2*a*- of the male threads 2*a* on the vessel 2, allowing an increase in the output to be detected upon abutment (see P in FIG. 14). This defines the incipient position of meshing engagement P.

When the controller 11 detects the abutment of the lowest extremity 5*a*- of the female threads 5*a* on the cap 5 against the top end 2*a*- of the male threads 2*a* on the vessel 2 in terms of the increase in the output torque, it increases the descending speed of the capping head 6 until it descends to the clamping zone B, thus urging the female threads 5*a* on the cap 5 against the male threads 2*a* on the vessel 2. The descending speed of the capping head 6 is increased in order to prevent the vessel 2 from being lifted up as the female threads 5*a* on the cap 5 are engaged with the underside of the male threads 2*a* on the vessel 2 to further the threadable engagement.

Because the cap 5 continues to rotate, the clamping operation is directly initiated. The controller 11 then stops the motor 9 when it has rotated through the given angle of rotation θ2, by which the cap 5 should rotate from the incipient position of meshing engagement. In this manner, the cap 5 rotates through the given angle of rotation θ2 from the incipient position of meshing engagement to complete the capping operation.

If the female threads 5*a* on the cap 5 are located above the female threads 2*a* on the vessel 2 after the lowest extremity 5*a*- of the female threads 5*a* on the cap 5 has abutted against the top end 2*a*- of the male threads 2*a* on the vessel 2, the angle through which the cap 5 rotates is wanting by about one revolution in order to complete the clamping operation, and accordingly, the torque which prevails when the clamping operation is completed is detected, and if it is less than the required torque value, the controller 11 determines that a rotation through a further revolution is wanting, thus causing the cap 5 to rotate through another revolution to achieve the predetermined angle of rotation in the similar manner as in the third embodiment.

Fifth Embodiment

In the first to the fourth embodiment, the output torque is detected by the torque detecting means 12, and the incipient position of meshing engagement P is detected on the basis of the detected value. However, in this embodiment, the torque measuring means 12 which has been used in the described embodiments to measure the rotational load is replaced by a load cell 21 which determines a vertical load. Thus, the capping apparatus includes a load cell 21 acting as load detecting means which is mounted on the splined shaft 8*a* connected to the chuck 7. The spring 14 is interposed between the load cell 21 and the chuck 7, and a vertical load applied to the load cell 21 from the chuck 7 (or cap 5) through the spring 14 is detected and is input to the controller 11.

Figure 15:
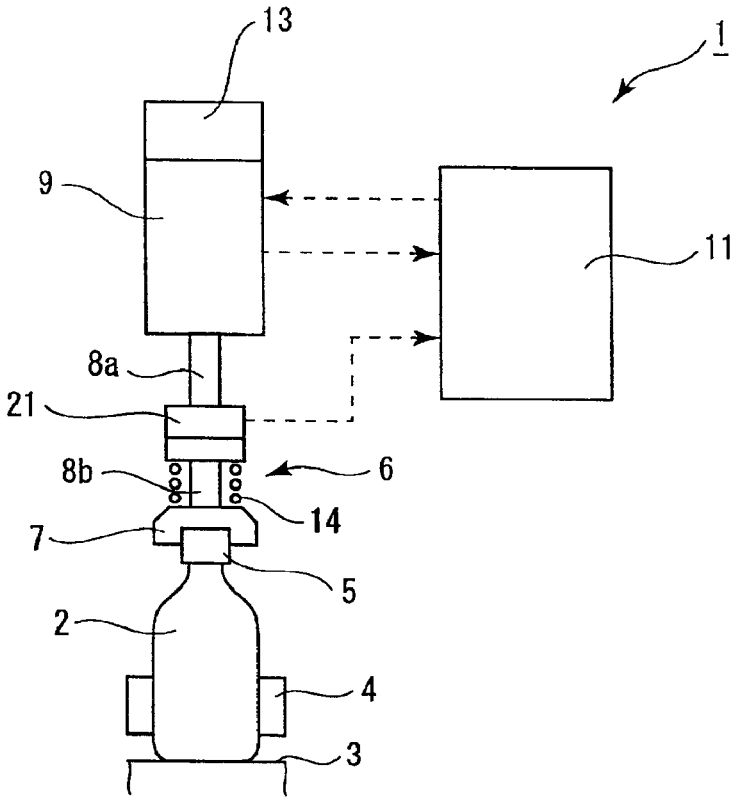
FIG. 15 is a front view of the essential parts of a fifth embodiment of the invention.
Figure 16:
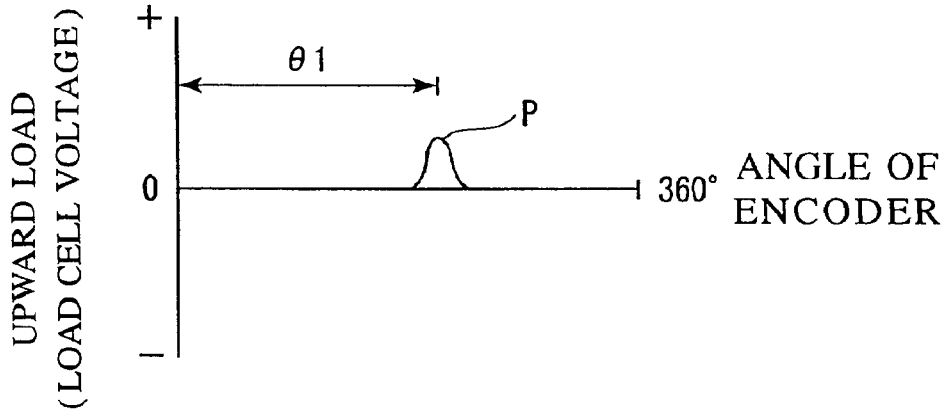
FIG. 16 is a diagram showing a relationship between a load measured with a load cell and an angle of rotation of an encoder in the fifth embodiment.

When the technology illustrated in the first embodiment is applied to the arrangement shown in FIG. 15, it will be seen that when the cap 5 is rotated through one revolution either in the clamping direction or in the reverse direction in the descent stop zone A shown in FIG. 3, the lowest extremity 5*a*- of the female threads 5*a* on the cap 5 abuts against the top end 2*a*- of the male threads 2*a* on the vessel 2 to increase a load on the cap 5 which is directed upward. Specifically, at this time, the upwardly directed load is detected by the load cell 21 in a manner shown in FIG. 16, whereby the incipient position of meshing engagement P can be detected. Again, a similar functioning and effect as achieved by the first embodiment can be obtained.

Sixth Embodiment

When the technology illustrated in the second embodiment is applied to the arrangement shown in FIG. 15, the incipient position of meshing engagement P can be detected by measuring the upwardly directed load which gradually increases and then rapidly decreases.

Specifically, when the cap 5 is rotated through one revolution in the direction which is opposite from the clamping direction when it is situated in the reverse zone A shown in FIG. 7, the lowest extremity 5*a*- of the female threads 5*a* on the cap 5 slides on a portion of the male threads 2*a* on the vessel 2 which is located to the left of the top end 2*a*-, gradually increasing the upwardly directed load which is applied to the cap 5. When the lowest extremity 5*a*- of the female threads 5*a* on the cap 5 is disengaged from the top end 2*a*- of the male threads 2*a* on the vessel 2, there occurs a rapid decrease in the upwardly directed load which is applied to the cap 5. Accordingly, this position can be detected as the incipient position of meshing engagement P. Again, a similar functioning and effect as achieved by the second embodiment can be achieved.

Seventh Embodiment

When the technology illustrated in the third embodiment is applied to the arrangement shown in FIG. 15, as the cap 5 is rapidly rotated in the clamping direction while it is situated in the rapid rotation zone A shown in FIG. 10, the lowest extremity 5*a*- of the female threads 5*a* on the cap 5 abuts against the top end 2*a*- of the male threads 2*a* on the vessel 2, and the lowest extremity 5*a*- of the female threads 5*a* is either lifted up or depressed by the male threads 2*a* immediately thereafter. Consequently, the load on the cap 5 which is directed either upwardly or downwardly increases rapidly, and such load can be measured by the load cell 21. Accordingly, a position where a load which is either upwardly or downwardly directed increases rapidly can be detected as the incipient position of the meshing engagement P. Again, a similar functioning and effect as those achieved by the third embodiment can be obtained. It will be apparent that if the technology illustrated in connection with the fourth embodiment is applied to the arrangement shown in FIG. 15 in the similar manner as in the seventh embodiment, there is obtained a similar functioning and effect as the seventh embodiment.

While the invention has been described above in connection with several embodiments thereof, it should be understood that a number of changes, modifications and substitutions therein are possible from the above disclosure without departing from the spirit and the scope of the invention defined by the appended claims.

What is claimed is:

1. A method of clamping a cap onto a vessel comprising the steps of:

providing a cap having threads, a vessel having threads with a predetermined winding angle adapted to engage with the threads of the cap, a capping head holding said cap and a motor for rotating the capping head in a clamping direction;

rotating the cap and the vessel relatively with respect to each other at an elevation where the threads on the cap and vessel are not engaged with each other;

detecting an incipient position of meshing engagement when the distal ends of the threads of the cap and vessel come into contact with each other by measuring the torque acting on the cap when the distal ends of the threads of the cap and the vessel come into contact with each other; and rotating the cap in a clamping direction by a predetermined rotational angle with respect to the incipient position of meshing engagement to clamp the cap to the vessel.

2. The method of claim 1, further comprising the steps of:

causing the cap held by the capping head to descend and fit around a mouth of the vessel;

stopping the descent at an elevation where the distal end of the threads on the cap abut against the distal end of the threads on the vessel;

rotating the cap until a position is reached where at least the distal ends of both threads on the cap and vessel abut against each other while measuring a change in the force acting on the cap under a condition of the descent having ceased; and detecting a position where an increase occurs in the acting force as an incipient position of meshing engagement where the distal ends of both threads first contact each other.

3. The method of claim 1, further comprising the steps of:

causing the cap held by the capping head to descend and fit around a mouth of the vessel;

rotating the cap in a direction opposite to the clamping direction until a rotational position is reached where at least the distal end of the threads on the cap disengage from the threads on the vessel while measuring a change in the force acting on the cap; and detecting a position where the acting force changes from increasing to decreasing as an incipient position of meshing engagement where the distal ends of both threads first contact each other.

4. The method of claim 1, further comprising the steps of:

causing the cap held by the capping head to descend and fit around a mouth of the vessel;

rotating the cap in the clamping direction during its descent at such a speed that the cap rotates through at least one revolution while it descends by a vertical distance corresponding to the width of one of the threads on the vessel;

continuing the rotation of the cap in the clamping direction until a rotational position is reached where at least the distal ends of both threads on the cap and the vessel abut each other while measuring a change in the force acting on the cap; and detecting a position where a change in the acting force occurs as an incipient position of meshing engagement where the distal ends of both threads first contact each other.

5. The method of claim 1, in which a rotational load acting on the cap is measured as the acting force.

6. The method of claim 1, in which a vertical load acting on the cap is measured as the acting force.

7. A capping apparatus for clamping a cap onto a vessel, said apparatus comprising:

a capping head for holding a cap having threads;

a motor for rotating the capping head in a clamping direction so that the cap can be clamped onto a vessel having threads with a predetermined winding angle adapted to engage with the threads of the cap;

an elevating mechanism for raising the capping head up and down;

measuring means for measuring torque acting on the cap held by the capping head;

angle detecting means for detecting an angular position to which the capping head is rotated; and control means for rotating the cap and the vessel relatively with respect to each other at an elevation where the threads on the cap and the vessel are not engaged with each other, detecting an incipient position of meshing engagement where the distal ends of both threads come into contact with each other by measuring the torque acting on the cap when the distal ends of the threads of the cap and vessel come into contact with each other, and rotating the cap in a clamping direction by a predetermined rotational angle with respect to the incipient position of meshing engagement to clamp the cap to the vessel.

8. The capping apparatus of claim 7, wherein the elevating mechanism ceases the descent of the capping head at an elevation where the clamping of the cap onto the vessel is to be initiated.

9. The capping apparatus of claim 7, wherein the elevating mechanism and the control means are arranged so that the cap is rotated in the clamping direction during its descent at such a speed that the cap rotates through at least one revolution while it descends by a vertical distance corresponding to the width of one of the threads on the vessel.

10. The capping apparatus of claim 7, wherein the control means measures a rotational load acting on the cap as the acting force.

11. The capping apparatus of claim 7, wherein the control means measures a vertical load acting on the cap as the acting force.

* * * * *